US006386604B1

(12) United States Patent
Scanlon

(10) Patent No.: US 6,386,604 B1
(45) Date of Patent: May 14, 2002

(54) BRACKET DEVICE

(76) Inventor: Terrie L. Scanlon, 8380 Atlas Ave. West, Inver Grove Heights, MN (US) 55077

( * ) Notice: Subject to any disclaimer, the term of this patent is extended or adjusted under 35 U.S.C. 154(b) by 0 days.

(21) Appl. No.: 09/488,984

(22) Filed: Jan. 21, 2000

(51) Int. Cl.[7] ..... E05C 17/54
(52) U.S. Cl. ..... 292/339; 292/262; 292/288
(58) Field of Search ..... 292/288, 289, 292/297, 290, 292, 120, 339, 262, 278

(56) References Cited

U.S. PATENT DOCUMENTS 967,948 A * 8/1910 Mellott ..... 292/292
973,959 A 10/1910 Nefflen
1,159,552 A * 11/1915 Truxell ..... 292/120
1,243,575 A 10/1917 Alexander
1,341,434 A 5/1920 Norris
2,565,906 A * 8/1951 Berthene ..... 16/86
2,742,679 A * 4/1956 Young ..... 20/58
2,919,946 A * 1/1960 Miener ..... 292/288
3,690,709 A * 9/1972 Bogusz ..... 292/262
3,747,272 A 7/1973 Martin
4,736,974 A 4/1988 Rosenthal
4,790,106 A 12/1988 La See
5,044,681 A * 9/1991 Neighbors ..... 292/288
6,003,911 A * 12/1999 Sowash ..... 292/343

* cited by examiner

*Primary Examiner*—Gary Estremsky

(57) ABSTRACT

A bracket device for holding a bottom window sash in a pivoted position in relation to a top window sash. The bracket device includes a pair of arms. Each of the arms is elongate. The arms have a first end and a second end. A first pair of elongate members is fixedly coupled to and extends away from one of the second ends of the arms. Each of the elongate members is oriented generally perpendicular to the arms. Each of the first ends of the arms is coupled together. The arms form an acute angle. A post is fixedly coupled to a juncture of the first ends of the arms. The post extends in a direction generally opposite of the first pair of elongate members.

5 Claims, 2 Drawing Sheets

BRACKET DEVICE

BACKGROUND OF THE INVENTION

1. Field of the Invention

The present invention relates to brackets and more particularly pertains to a new bracket device for holding a bottom window sash in a pivoted position in relation to a top window sash.

2. Description of the Prior Art

The use of brackets is known in the prior art. More specifically, brackets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 1,243,575; 1,341,434; 3,747,272; 973,959; 4,736,974; and 4,790,106.

While these devices fulfill their respective, particular objectives and requirements, the aforementioned patents do not disclose a new bracket device. The inventive device includes a pair of arms. Each of the arms is elongate. The arms have a first end and a second end. A first pair of elongate members is fixedly coupled to and extends away from one of the second ends of the arms. Each of the elongate members is oriented generally perpendicular to the arms. Each of the first ends of the arms is coupled together. The arms form an acute angle. A post is fixedly coupled to a juncture of the first ends of the arms. The post extends in a direction generally opposite of the first pair of elongate members.

In these respects, the bracket device according to the present invention substantially departs from the conventional concepts and designs of the prior art, and in so doing provides an apparatus primarily developed for the purpose of holding a bottom window sash in a pivoted position in relation to a top window sash.

SUMMARY OF THE INVENTION

In view of the foregoing disadvantages inherent in the known types of brackets now present in the prior art, the present invention provides a new bracket device construction wherein the same can be utilized for holding a bottom window sash in a pivoted position in relation to a top window sash.

The general purpose of the present invention, which will be described subsequently in greater detail, is to provide a new bracket device apparatus and method which has many of the advantages of the brackets mentioned heretofore and many novel features that result in a new bracket device which is not anticipated, rendered obvious, suggested, or even implied by any of the prior art brackets, either alone or in any combination thereof.

To attain this, the present invention generally comprises a pair of arms. Each of the arms is elongate. The arms have a first end and a second end. A first pair of elongate members is fixedly coupled to and extends away from one of the second ends of the arms. Each of the elongate members is oriented generally perpendicular to the arms. Each of the first ends of the arms is coupled together. The arms form an acute angle. A post is fixedly coupled to a juncture of the first ends of the arms. The post extends in a direction generally opposite of the first pair of elongate members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bracket device apparatus and method which has many of the advantages of the brackets mentioned heretofore and many novel features that result in a new bracket device which is not anticipated, rendered obvious, suggested, or even implied by any of the prior art brackets, either alone or in any combination thereof.

It is another object of the present invention to provide a new bracket device which may be easily and efficiently manufactured and marketed.

It is a further object of the present invention to provide a new bracket device which is of a durable and reliable construction.

An even further object of the present invention is to provide a new bracket device which is susceptible of a low cost of manufacture with regard to both materials and labor, and which accordingly is then susceptible of low prices of sale to the consuming public, thereby making such bracket device economically available to the buying public.

Still yet another object of the present invention is to provide a new bracket device which provides in the apparatuses and methods of the prior art some of the advantages thereof, while simultaneously overcoming some of the disadvantages normally associated therewith.

Still another object of the present invention is to provide a new bracket device for holding a bottom window sash in a pivoted position in relation to a top window sash.

Yet another object of the present invention is to provide a new bracket device which includes a pair of arms. Each of the arms is elongate. The arms have a first end and a second end. A first pair of elongate members is fixedly coupled to and extends away from one of the second ends of the arms.

Each of the elongate members is oriented generally perpendicular to the arms. Each of the first ends of the arms is coupled together. The arms form an acute angle. A post is fixedly coupled to a juncture of the first ends of the arms. The post extends in a direction generally opposite of the first pair of elongate members.

Still yet another object of the present invention is to provide a new bracket device that prevents a bottom window sash from moving in relation to a top window sash.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
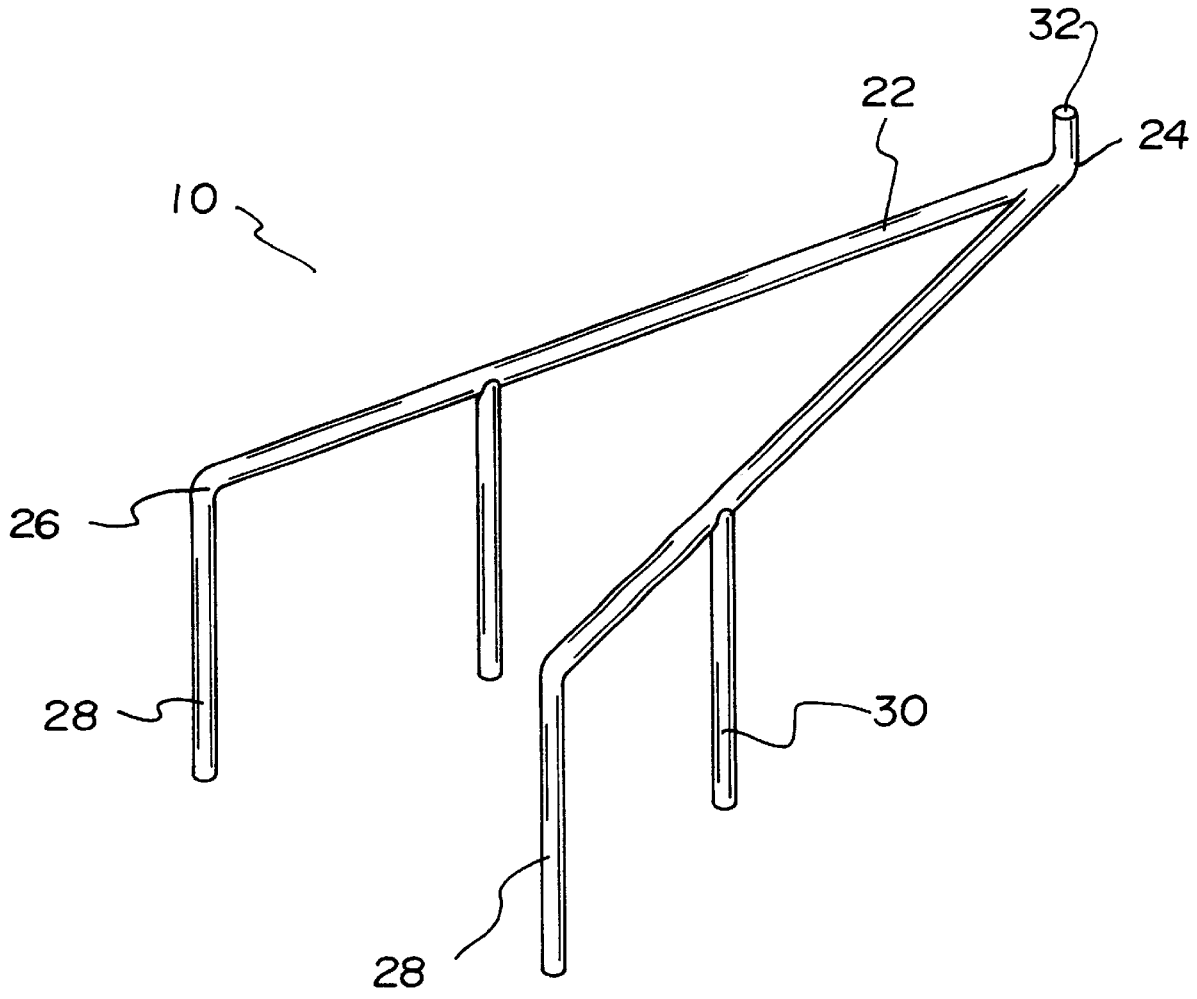
FIG. 1 is a schematic perspective view of a new bracket device according to the present invention.
Figure 2:
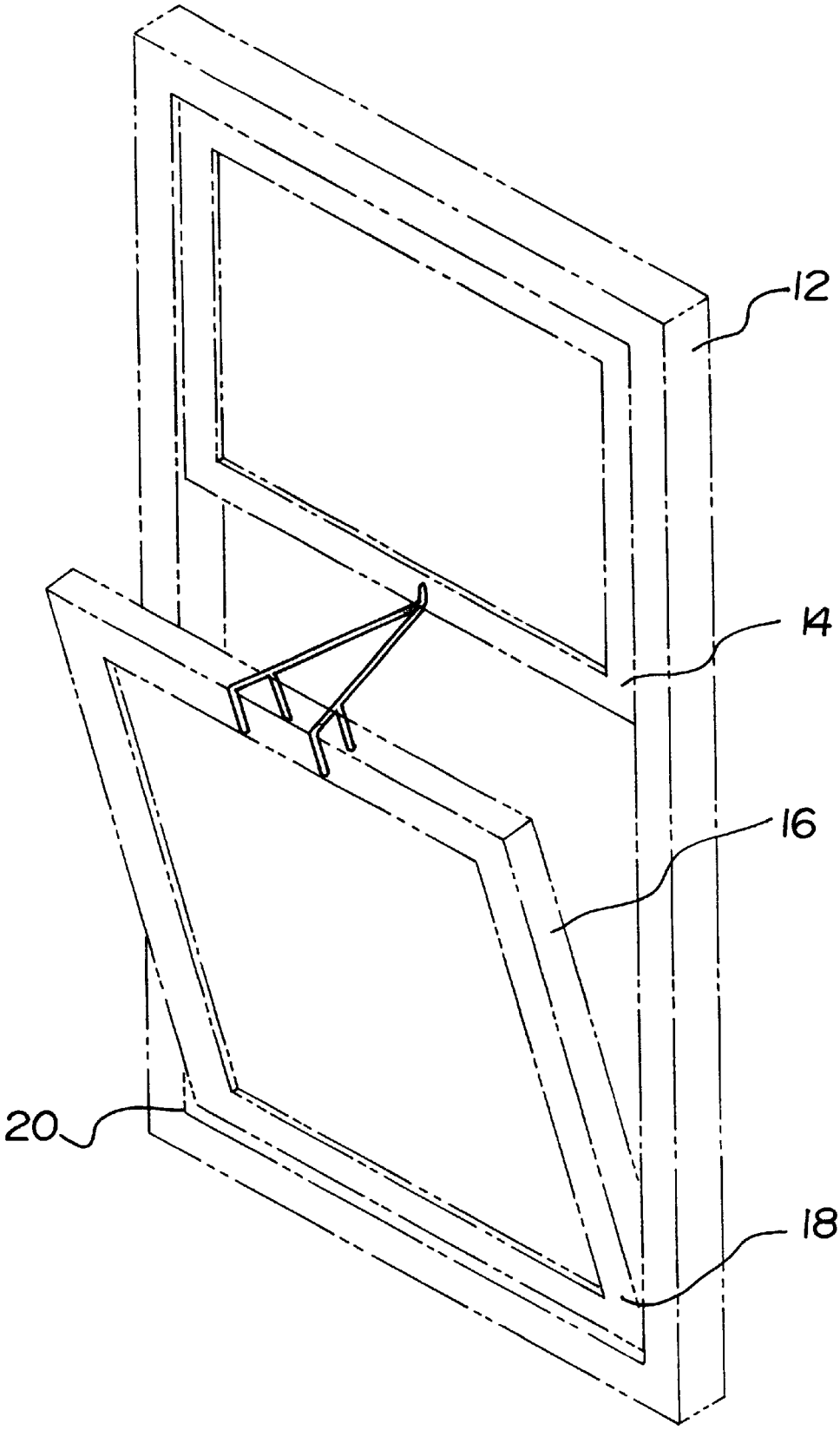
FIG. 2 is a schematic perspective view of the present invention holding a window sash open.

With reference now to the drawings, and in particular to FIGS. 1 through 2 thereof, a new bracket device embodying the principles and concepts of the present invention and generally designated by the reference numeral 10 will be described.

As best illustrated in FIGS. 1 through 2, the bracket device 10 generally comprises a window 12. The window has a top window sash 14 and a bottom window sash 16. The bottom window sash 16 has a bottom portion 18 hingedly coupled to a bottom portion of a frame 20 of the window 12.

A pair of arms 22, each being elongate, has a first end 24 and a second end 26. The arms 22 both have a generally annular cross-section taken transverse to a longitudinal axis of the arms.

Each of a first pair of elongate members 28 is fixedly coupled to and extends away from one of the second ends 26 of the arms 22. Each of the elongate members 28 are oriented generally perpendicular to the arms 22.

Each of a second pair of elongate members 30 is fixedly coupled to one of the arms 22. Each of the second pair of elongate members 30 is generally located between the first 24 and second 26 ends of the arms 22. The second pair of elongate members 30 is oriented generally parallel to the first pair of elongate members 28. The first 28 and second 30 elongate members extend in a generally identical direction.

The first ends 24 of the arms 22 are coupled together, and form an acute angle. The angle is between 60 degrees and 30 degrees, wherein the first 28 and second 30 pair of elongate members extend in a direction generally perpendicular to the longitudinal axes of both of the arms 22.

A post 32 is fixedly coupled to a juncture of the first ends 24 of the arms. The post 32 extends in a direction generally opposite of the first 28 and second 30 pair of elongate members.

The post 32 is removably coupled to the top window sash 14 and the top edge of the bottom window sash 16 is placed between the first 28 and second 30 pair of elongate members to hold the bottom window sash in a pivoted position in relation to the top window sash.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bracket device for holding a bottom window sash in a pivoted position in relation to a top window sash, said device comprising:

a pair of elongate arms, each of said arms having a first end and a second end, wherein said first ends of said arms are coupled together such that said arms form an acute angle;

a first pair of elongate members, each of said elongate members being fixedly coupled to and extending away from one of said second ends of said arms, each of said elongate members being oriented generally perpendicular to said arms;

a second pair of elongate members, each of said second pair of elongate members being fixedly coupled to one of said arms, each of said second pair of elongate members being generally located between said first and second ends of said arms, said first and second elongate members extending in a generally identical direction; and a post being fixedly coupled to a juncture of said first ends of said arms, said post extending in a direction generally opposite of said first pair of elongate members.

2. The bracket device as in claim 1, wherein said acute angle is between 60 degrees and 30 degrees.

3. The bracket device as in claim 1, wherein each of said arms has a generally annular cross-section taken transverse to a longitudinal axis of said arms.

4. The bracket device as in claim 1, wherein each of said second elongate members being oriented generally parallel to said first pair of elongate members.

5. A bracket device for holding a bottom window sash in a pivoted position in relation to a top window sash, said device comprising:

a pair of elongate arms, each of said arms having a first end and a second end, wherein said first ends of said arms are coupled together such that said arms form an acute angle;

a first pair of elongate members, each of said elongate members being fixedly coupled to and extending away from one of said second ends of said arms, each of said elongate members being oriented generally perpendicular to said arms;

a second pair of elongate members, each of said second pair of elongate members being fixedly coupled to one of said arms, each of said second pair of elongate members being generally located between said first end of said arms and one elongate member of said first pair of elongate members, said first and second elongate members extending in a substantially identical direction; and a post being fixedly coupled to a juncture of said first ends of said arms, said post extending in a direction generally opposite of said first pair of elongate members.

* * * * *